United States Patent [19]

Lewis

[11] Patent Number: 5,070,807

[45] Date of Patent: Dec. 10, 1991

[54] TEMPORARY CANOPY FOR SMALL WATERCRAFT

[75] Inventor: Michael L. Lewis, Panama City, Fla.

[73] Assignee: The United States of America as represented by the Secretary of the Navy, Washington, D.C.

[21] Appl. No.: 562,496

[22] Filed: Aug. 2, 1990

[51] Int. Cl.[5] ..... B63B 17/00

[52] U.S. Cl. ..... 114/361; 441/40; 114/345

[58] Field of Search ..... 114/345, 349, 361, 348, 114/351; 441/40, 38; 135/88, 101, 102, 104, 901, 905, DIG. 1, DIG. 9

[56] References Cited

U.S. PATENT DOCUMENTS

| | | | |
|---|---|---|---|
| 1,519,691 | 12/1924 | Mizrahi | 114/361 |
| 3,898,947 | 8/1975 | Moore | 114/361 |
| 4,075,723 | 2/1978 | Bareis et al. | 114/361 |
| 4,766,918 | 8/1988 | Odekirk | 114/345 |
| 4,966,091 | 10/1990 | DeSuarez D'Aulan | 14/345 |

*Primary Examiner*—Ed Swinehart
*Attorney, Agent, or Firm*—Sol Sheinbein

[57] ABSTRACT

This invention is a lightweight, potentially expendable, temporary canopy assembly for small open type watercraft. The thin resilient battens are interconnected in the form of a bowed longitudinal ridge member having a plurality of shorter length, transversely disposed, longitudinally spaced, bowed rib members connected therewith, with the free ends of the battens, inserted through D-ring type attachment means provided on the inner periphery of the watercraft, while exerting frictional tension against the craft's gunwales areas. A flexible Nylon type cover comprised of selectively joinable half sections is used as the protective canopy. It uses preferably complementally mateable hooks and loops type manual fastener means, such as Velcro ® complemental fastener strips, to provide the selective attachment and detachment of the two halves over the bowed center ridge member, and also to detachably secure the canopy perimeter portions to the gunwale areas. The canopy half portions are adapted to be furled down from the center ridge and retained against the side gunwale areas by overlaid portions of a preexisting gunwale area peripherally extended safety line or cargo tie down rope.

11 Claims, 3 Drawing Sheets

FIG. 4
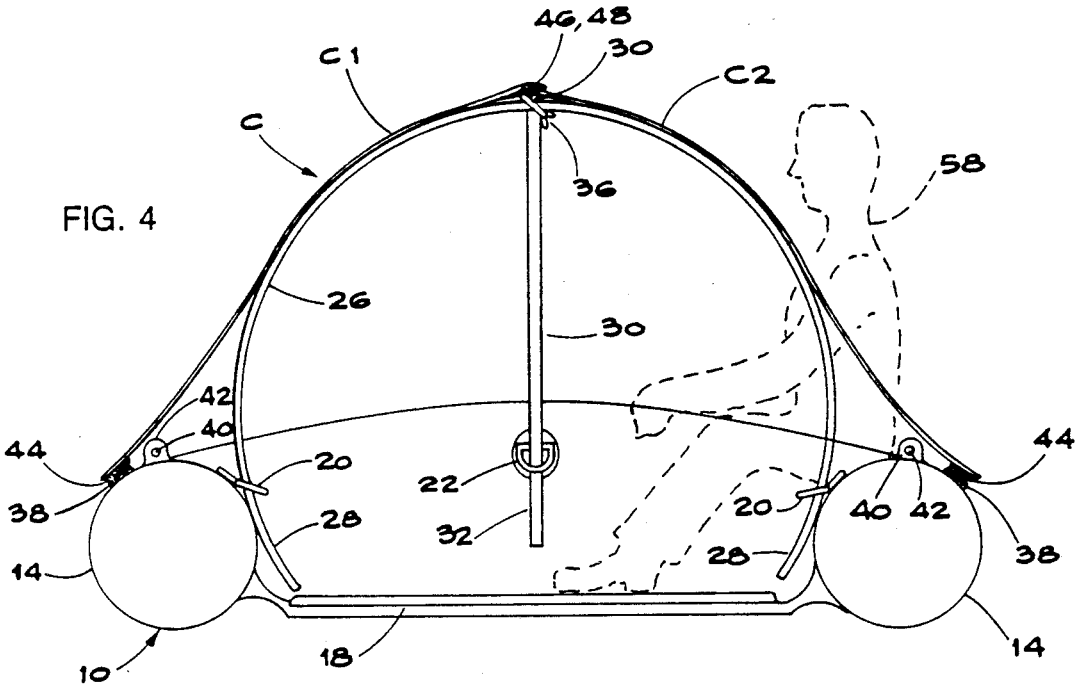
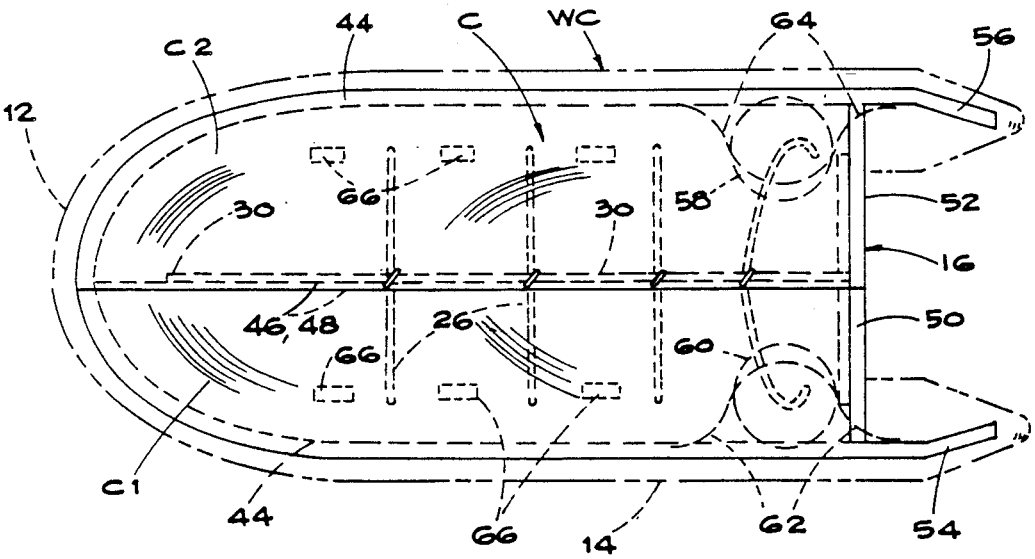
FIG. 5
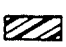
FIG. 7A
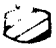
FIG. 7B
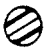
FIG. 7C
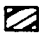
FIG. 7D

TEMPORARY CANOPY FOR SMALL WATERCRAFT

The invention described herein may be manufactured and used by or for the U.S. Government for governmental purposes without the payment of any royalties therefor or thereon. This application and patent are being assigned outright to the U.S. Government.

BACKGROUND OF THE INVENTION

1. Field of the Invention.

The present invention relates generally to temporary removable covers or canopies for various watercrafts or boats, and more particularly relates to detachable and expendable weather protective shields or covers for use with military assault craft or similar non-military type watercraft to protect its occupants from undue water spray and other environmental factors. Some of the craft may be of the inflatable type.

2. Description of Prior Art.

The prior art teaches various detachable canopy and shelter arrangements for many types of watercraft and boats generally. Among those are the prior patents referred to in U.S. Pat. No. 3,896,832 issued to Montoya. Both the Montoya U.S. Pat. No. 3,896,832 and the Johnson U.S. Pat. No. 4,706,599 teach the use of releasably connectable mating strips of hooks and loops Velcro® fastener means for removably attaching portions of its flexible canopy members to their supports and/or to the gunwales or other areas of their boats, which is only one of the features in common with the present invention.

More specifically among the prior art, U.S. Pat. No. 1,396,063 to Schmidt discloses a structure in which support ribbing for a canoe canopy is affixed to the gunwale of the canoe. In the U.S. Pat. No. 3,422,829 to Adams he teaches a foldable life-boat cover having a rigid support ribbing fixed to the gunwales, as does Koontz, et al in U.S. Pat. No. 3,698,409. U.S. Pat. No. 2,493,833 to Reynolds, U.S. Pat. No. 2,864,391 to Stark, and U.S. Pat. No. 3,896,832 to Montoya teach the use of various differently arranged removable bows or rib-like canopy support members to form a boat cover detachable framework which can be applied to and removed from the boat by one person.

OBJECTS AND BRIEF SUMMARY OF THE INVENTION

A primary object of this invention is to provide an improved and simplified detachable weather protective, cover-support framework and cover, of which at least the framework may be readily jettisoned and considered expendable if necessary, particularly for certain military applications. The canopy assembly is quite adaptable for use with various types of both military and civilian watercraft whether of the rigid or inflatable hull type.

Another object is to utilize elongated sections of non-metal, resilient, semi-flexible strip material, such as fiberglass bands or strip-like battens, for canopy supportable bowed ribs, which rib and similar material ridge sections are of a character such that when an applied tension thereon is released, they will resume their normal straight character. These bowable sections are sufficiently flexible to cooperate with preexisting potential securing rings provided on one type of military inflatable assault craft, known as the Zodiac Marine Commando F-470 ten man inflatable assault craft, manufactured by the Zodiac Company, Moulineaux, France.

Still another object is to provide a detachable cover of the aforesaid character, with a longitudinally divided two-part flexible canopy which is detachably secured by cooperatively mating hooks and loops Velcro® fastener strips along the peripheral gunwale portions and which two sections can be also detachably fastened along the bowed top ridge member by the same type of manually workable Velcro® fasteners or zippers, the canopy being of a character which can be readily furled out of the way along the opposite side gunwales when not needed.

Yet another object is to provide such a detachable framework and cover system which can be either readily stowed on or with the craft when not needed or can be partially or fully jettisoned depending upon the circumstances involved in the use of the craft.

These and other objects are achieved by the provision of a preshaped longitudinally divided cover or canopy to cooperatively fit over a framework of interconnected ridge and transverse bowed rib sections cooperatively removably attached to the various intermediate and peripheral portions of the watercraft with which it is to be associated. The longer ridge member is bowed and connected to fore and aft portions of the craft, while the plurality of transversed bowed rib members are connected at spaced intervals to opposite sides of the watercraft inwardly adjacent the gunwale areas, with the top middle portions of the bowed ribs being suitably interconnected with the ridge member as by flexible twist-tie members, tape, or the like. The lowermost peripheral portions of the canopy are provided with strips of one type of a complemental hooks and loops cooperative Velcro® fastener means and are adaptable to cooperate with strips of another mateable complemental Velcro® fastening material, which latter strips preferably are adhesively attached to the craft's fore and aft and side gunwale areas. The same type of cooperative Velcro® fasteners or fastening material is preferably used along the longitudinally divided canopy members, although zipper type fastener means may be considered.

These and further objects and advantages will become more apparent from the following detailed description taken in conjunction with the following illustrative drawing figures.

BRIEF DESCRIPTION OF DRAWINGS

FIG. 4 is an enlarged semi-schematic transverse sectional view showing some details of the relative attaching means for the canopy supporting bow and ridge members, as well as for that of the canopy extended over the ridge member and attached to the respective side gunwale areas of the inflatable watercraft;

FIG. 5 is a top plan view showing the canopy cover in place over the supporting framework which is shown in dashed lines, and with the watercraft outline shown in broken dash-dot outline;

FIGS. 7A–7D are examples of cross-sections of various types of flexible members used for ridge and bow members of the framework.

DETAILED DESCRIPTION OF PREFERRED EMBODIMENT

Figure 1:
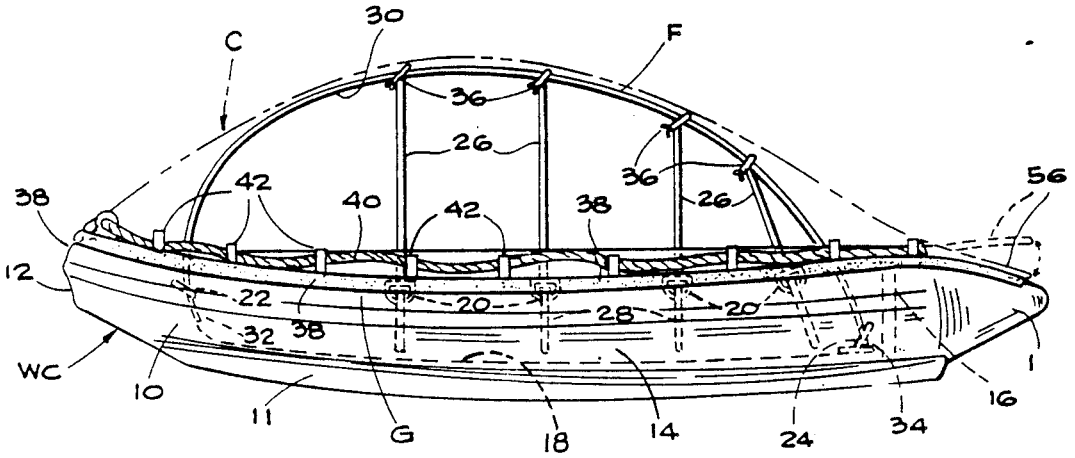
FIG. 1 is a side elevational view of the canopy supporting framework shown in association with an inflatable type watercraft, with the canopy outline shown in phantom broken lines.
Figure 2:
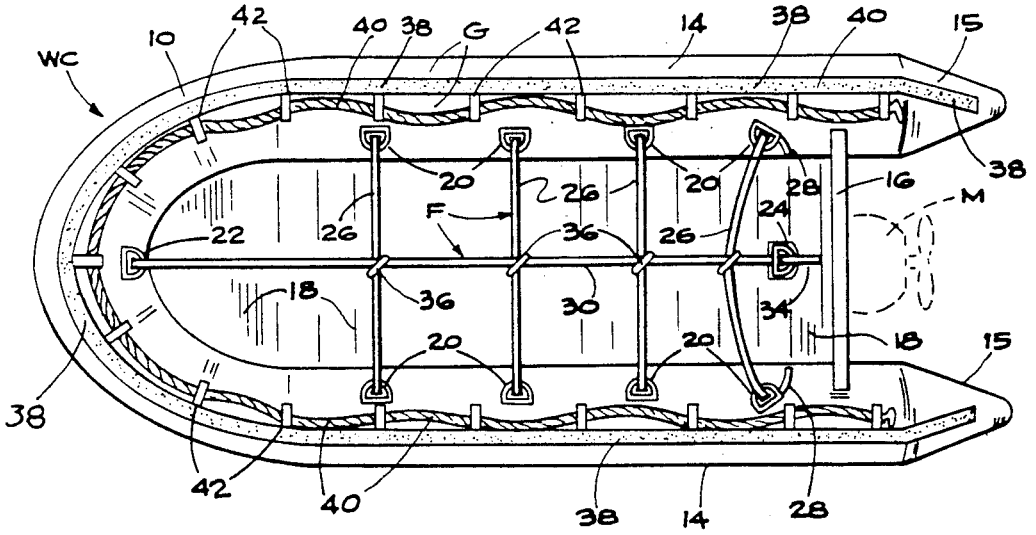
FIG. 2 is a top plan view of the canopy framework and watercraft of FIG. 1, omitting any showing of the canopy cover.
Figure 3:
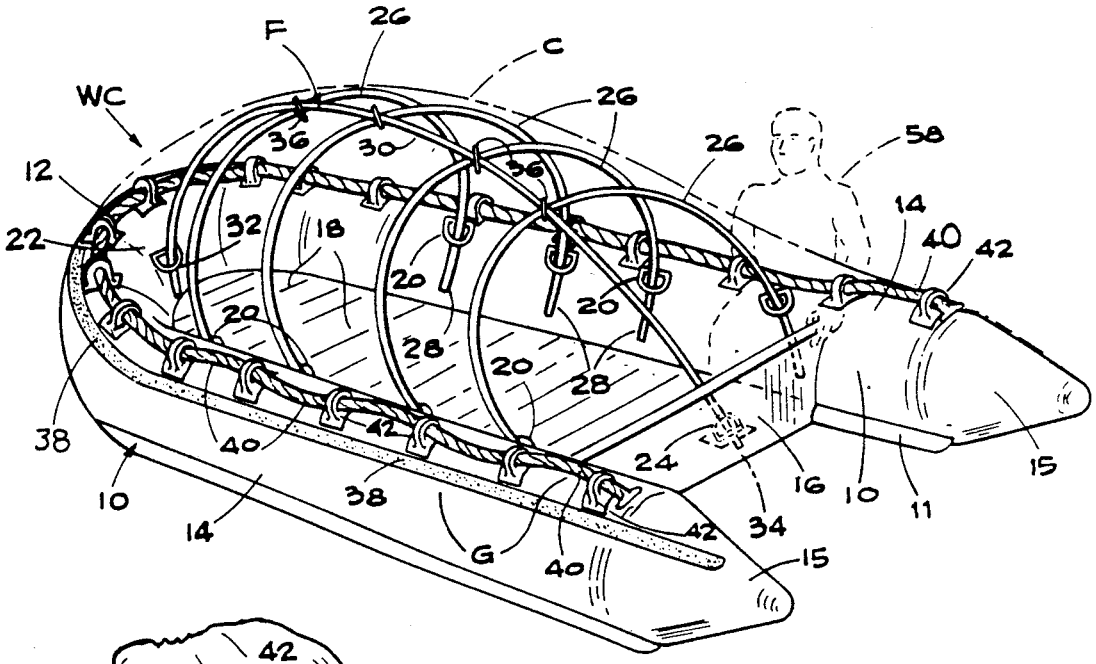
FIG. 3 is a perspective view of the watercraft and canopy framework of FIGS. 1 and 2, without the canopy cover.

Referring more particularly to the drawing FIGS. 1, 2, and 3, the illustrative inflatable type watercraft is generally designated WC, and has a canopy-supporting framework F removably attached therewith to support the openable-closable protective canopy C. The invention hereof is particularly adaptable for use with an inflatable, military type, self-contained, assault craft, such as the ten man Zodiac Marine Commando F470 craft manufactured by the Zodiac Company in Moulineaux, France.

The craft WC, which for this exemplary type is approximately 6'-3" wide by 15'-5" long, is characterized by a main large diameter buoyancy tube 10, approximately twenty inches in diameter, of generally U-shape having a bight portion 12 generally forming a somewhat tapered bow which interconnects the generally parallel sides 14,14. A transversely disposed transom member 16 interconnects the rearward portions of the two sides 14,14, slightly forward of the terminal cone portions 15,15. The transom is adapted to mount a suitable outboard motor M, FIG. 2. The main buoyancy tube 10 is provided with a plurality of separate airtight chambers, and has connected therewith at least one similar U-shape but smaller diameter shock absorbancy tubes or speed skegs 11 beneath tube 10, and appropriate inflatable keel tube, not shown, and flooring means generally designated 18. Floor means 18 extends laterally between the two side tube portions 14,14 and fore and aft between the bow 12 and transom 16.

The buoyancy tube 10 and related floor and hull portions are preferably fabricated of a heavy duty, polyamide Neoprene®-type-coated Nylon® fabric. A plurality of interiorly disposed, peripherally spaced attachment means are provided a short distance below the U-shaped top edge or gunwale area G of the craft, at least some of which means are in the form of heavy duty, side-disposed, corrosion-resistant, D-rings 20, a central, forwardly disposed D-ring 22, and a central, rearwardly disposed, attachment means which also may be in the form of a D-ring 24.

Proceeding to the framework F, it is fabricated from a plurality of elongated, non-metal, resilient, semi-flexible strips or rod members. These members may be of a material such as fiberglass bands or the like and may be narrow strip-like battens. FIGS. 7A–7D represent examples of different shaped cross-sections which the flexible bands or rod members may have. The strip type band material is of a character such that when an applied tension thereon is released, the bands will resume their normal straight character. Four identical batten strips or bands 26 of approximately nine feet long are arched to permit their respective ends 28 to be inserted downwardly through opposed pairs of the side-disposed D-rings 20. Due to the inherent resiliency of the strip material, ends 28 are tensioned into frictional engagement with the inside walls of the buoyancy tube's side portions 14,14, as more clearly seen in FIGS. 3 and 4. The longitudinally spaced arched bands 26 constitute canopy-supportable bow members forming a major portion of the framework F. The rearwardmost bow 26 may be slightly inclined forwardly, as shown. This facilitates a more streamline profile of the frame F and canopy C when the bows 26 are interconnected with a longer length, approximately 18 feet long, longitudinally bowed band member constituting the ridge member 30. Ridge member 30 has one end 32 inserted through the forwardly disposed central D-ring 22 and becomes frictionally engaged with the inward edge of the craft's forward bow portion 12, in a like manner in which the transverse bow members 26 were installed. Ridge member 30 is longitudinally arched backwardly so as to engage the central top portions of the transverse bows 26, with the rearward end portion 34 preferably being similarly attached to the rear D-ring 24.

The intersections of the ridge member 30 with the top central portions of transverse bows 26 are positively interjoined by any suitable readily removable or releasable attachment means, such as nylon tie wrap fasteners 36, twist ties, spring clips or the like. The fore and aft ends of tensioned ridge member 30 are also positively but removably attached to their respective D-rings, to complete the assembly of the skeletal framework F, and to better assure that it doesn't become jarred loose from its frictional anchorage with the D-rings and sides of the watercraft. One or more pair of end portions 28 of the transverse bows 26 may also be optionally removable tied or clipped to their associated D-rings to provide supplemental anchorage more particularly if the craft is expected to encounter rough water and/or high velocity wind.

To provide for attachment of the canopy C, complementally mating hook and loop type manual fastener means such as Velcro® fastener preferably are used to good advantage. The gunwale portions of the craft WC are provided with adhesively attached four-inch-wide Velcro® fastener strips 38 of the hooked type. These preferably form a substantially continuous fastener strip from around the forward bow back beyond the transom area to the tapered cone portions 15,15 of the boat, although for some installations, the strips may be applied at intervals. These same type fastener strips 38 are disposed preferably outwardly adjacent the craft's peripherally attached flexible safety and cargo tie-down rope 40, which rope is shown threaded through circumferentially spaced anchorage eyelets 42.

The longitudinally divided canopy C is comprised of two basic halves C1, C2 which are adapted to be selectively joinable, and are shaped to collectively conform to the erected skeletal framework F and the watercraft's gunwale areas G when so interjoined along the ridge member 30. To effect this arrangement, the outermost peripheral sides and front margins of each canopy half portion are suitably provided with the complementary loop type form of Velcro® fastener means or strips 44, FIGS. 4,5, and 6. These fastener strips 44 may be either stitched or adhesively applied. The two canopy sections' longitudinal inwardly oriented edges are also provided with complementary fastener means to permit their selective mutual fastening and unfastening. Although various types of fastener means such as plural zippers, hooks and eyelets, or button forms might be acceptable, the preferred form is the same non-metallic, complementary hooks and loops Velcro® fastener strips 46, 48, as shown in FIGS. 4 and 5. The use of the Velcro® fastener strips will better enable not only selective opening and closing of the full or partial ridge area of the canopy, but also selective attachment of the outer peripheral portions to the respective gunwale areas as will be further described hereinafter.

A preferred assembly of the canopy sections C1, C2 to each other and to the boat includes first mating the bottom or outermost fastener strips or edges 44 of each half portion C1, C2 to its complementary perimeter or gunwale attached complemental fastener strip 38. Then starting at the forward bow, the medial or central longitudinal mateable edges 46,48 of the two half sections are progressively mated or pressed together over the ridge member 30, continuing all the way back to the stern. The rearward margins 50,52, FIG. 5, of the respective half sections C1, C2 preferably are provided with stiffened reinforced edges or hems to preclude fraying and to minimize their flapping at high speed. Although these edges 50,52 are not normally intended to be secured to the transom 16, when used with Navy assault type watercraft, similar cooperable hooks and loops Velcro® fastener type patches 66 may be optionally provided for certain other applicational uses if desired.

Each canopy section C1, C2 has an outer rearwardly extended strap 54,56 seen in, FIG. 5, which extends from about twelve to sixteen inches beyond the rearward edges 50,52. These handle-like extended strips are provided with fastener means adaptable to mate with the complementary terminal portions of other cooperable fastener strips 38 which extend along the rearward cone portions 15,15, for a purpose to be now described.

When the craft is boarded by Navy special warfare troops or other occupants, most of whom are sheltered beneath the erected canopy, the rearwardmost two occupants at opposite sides usually are the boat operator 58 and an observer or lookout person 60, denoted schematically by the circles 58,60 in FIG. 5. In order to accommodate these rearwardly seated occupants whose upper bodies necessarily are more exposed to the elements, the respective canopy sections C1, C2 are unfastened from their outer perimeter portion and wrapped over the laps and mid-body portions of these occupants, as schematically shown by the dash-dot arcuate lines 62 and 64, respectively, in FIG. 5. The respective extension strips 54 and 56 are used by these occupants to facilitate the manual securing down of the canopy sections after being draped across them to provide as much protection as possible from the sea spray and/or wind and rain under adverse climatic conditions. These same end strips 54,56 also enable the occupants to grasp and detach the strips from their secured mode when it is desired to disembark or otherwise initiate partial or full disassembly of the canopy sections.

Figure 6:
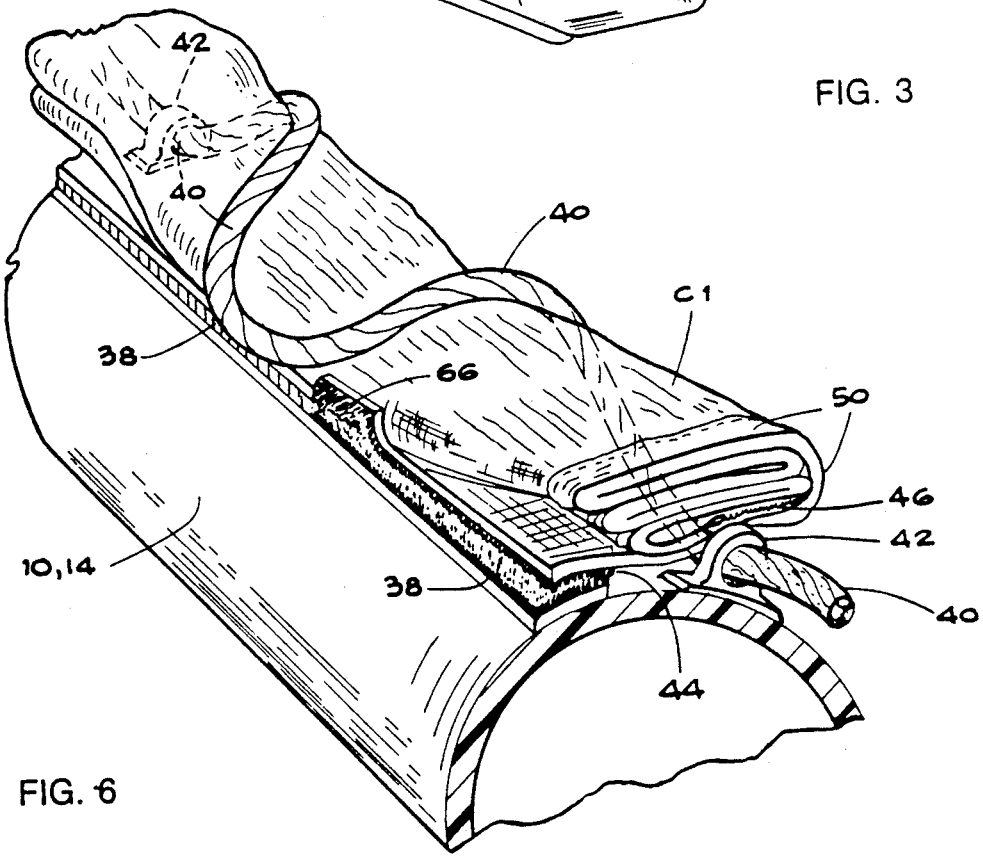
FIG. 6 is a fragmentary perspective detail view showing a portion of the canopy furled down for retention on a gunwale portion of the craft's buoyancy tube.

When the canopy is unneeded, the ridge oriented mutually cooperable fastener strips 46,48 are completely separated and are respectively furled down to lay adjacent the opposite side gunwales areas. To positively confine the furled canopy sections, portions of the slackened safety line 40 of fibrous rope can be stretched and wrapped over the furled canopy and selectively attached by means of its inherent fibers which catch to some partially exposed portions of the Velcro® fastener hooks strips 38, as shown in the fragmentary perspective view of FIG. 6. Supplementally or alernatively, suitable loop type fastener Velcro® patches 66, FIGS. 5 and 6, are contemplated to be strategically placed at spaced intervals on the underside of C1, C2 to better assure the desired containment of these furled canopy sections.

For military applications in conjunction with the briefly described Zodiac Marine Commando inflatable assault craft, the boat is self-contained and when used with its $CO_2$ inflation system, will deploy its hull with integrated floorboard means and will self-inflate within four minutes. The improved canopy system can be included therewith. The rugged overall character of the boat and this temporary canopy system enables it to be dropped by parachute or helicopter. During heliborne operations, it may be deployed onto the ground or into the water in already essentially inflated condition with the canopy skeletal framework already assembled and secured, and the canopy sections in their furled condition.

The subject invention provides a mission compatible econmic means of providing water spray, wind and chill protection for its occupants. More particularly, military special warfare units need a low cost, potentially expendable, lightweight multipurpose protective weather shield, suitably camouflaged, for their inflatable type watercraft, capable of temporarily protecting its occupants during combat type covert raiding craft operations. This portable canopy system enables the troops to arrive at their destination at a better level of comfort which will better enable them to carry out their assigned tasks.

From the foregoing detailed description, it is apparent that an improved lightweight, quickly deployable canopy assembly and related method has been evolved which has many salient features. Some of the various and unique features and advantages, which heretofore are not believed to have been combined into one system, include:

(a) versatility, with an inherent capability to be used as a temporary shelter or canopy not only on a boat or watercraft, but also on shore, with or without camouflage patterns. Its flexible strips or battens can be utilized to make emergency radio antennae;

(b) ease of assembly and disassembly, which allows either operation quickly in even very adverse weather conditions;

(c) minimal or no radar cross-sectional signatures are generated due to lack of metal components in the frame and canopy per se;

(d) most on-site repairs can be achieved easily and inexpensively, for which Velcro® type fastener means, tape, tie-wraps, adhesive, and batten strips would cover all but the most extensive repairs;

(e) the canopy can be vented from any quarter, top or bottom, to adapt to changing wind conditions which might be carrying fumes, smoke, or other harmful substances;

(f) lightweight components, few in number, weighing less than 7 lbs and lends itself well to compact storage until needed;

(g) shelter or canopy height can be easily changed by varying the length of the various batten strips;

(h) adjustable height and profile to a limited extent; and (i) when used aboard a watercraft, if circumstances dictate, it can be quickly jettisoned, as by cutting the plastic tie wraps or untwisting the twist-ties, enabling the shelter to be quickly discarded in whole or in part.

It will be appreciated by those skilled in the art that this portable canopy system is intended primarily for open cockpit or open area watercraft. It is further contemplated that the canopy cover sections may comprise some portions that are of thin, flexible, transparent character as well as some of flexible screening material.

While specific preferred embodiments have been described and shown according to the presently discerned best mode for carrying out the invention, it is understood that various other modifications and adaptations may be achieved without departing from the spirit and scope of my invention as defined in the appended claims.

What is claimed is:

1. A generally low profile, lightweight canopy assembly for a watercraft which embodies a transom member with a top edge generally coplanar with peripheral side wall gunwale areas, said craft also having a plurality of interiorly disposed, peripherally spaced attachment means adaptable for attaching various items, a safety grab line, as well as canopy-supporting frame members thereto, said canopy assembly comprising:

(a) a normally straight but bowable, elongated, narrow width member of a length when disposed in a longitudinally bowed manner on the craft and when attached or anchored near its opposite ends to interior fore and aft portions of the craft, forms an arched canopy-supportable ridge member;

(b) a plurality of normally straight but bowable, elongated, narrow width members of a length shorter than said ridge-forming member, and adaptable to be resiliently arched into respective canopy-supporting bows, said bows adapted to be disposed transversely to said longitudinal bowed ridge member;

(c) said transversely disposable bow members having opposite free ends adapted to resiliently engage with and be releasably retained collectively by said craft's interior side walls and interiorly disposed circumferentially spaced attachment means;

(d) means for at least temporarily interjoining said ridge member and said transversely disposed bow members to complete a canopy-supportable framework in conjunction with said watercraft;

(e) a generally rectangular shape, separable, two piece, longitudinally dividable flexible canopy means having fastener means for releasably interjoining said two pieces along the longitudinal center area;

(f) said canopy means having fastening means along substantially all of an outermost periphery except for the rear transom area for releasably and selectively attaching it to complemental fastening means provided on the craft's peripheral gunwale area;

(g) whereby when installed on such a watercraft it will provide a readily detachable and selectively openable and closable canopy to protect the craft's occupants from adverse water spray and ambient atmospheric conditions.

2. The canopy assembly of claim 1, wherein said interiorly disposed, peripherally spaced attachment means in said watercraft are heavy duty D-rings disposed in a manner which facilitates frictional insertion therethrough of respective opposite free ends of said respective transverse bow members for frictional engagement with both an interior wall portion of said watercraft and with said respective D-rings.

3. The canopy assembly of claim 1, wherein all component parts of said assembly are of non-metallic materials to minimize generating a telltale acoustical reflective signature and to minimize oxidation in the ambient atmosphere.

4. The canopy assembly of claim 1, wherein said outer peripheral fastening means on said canopy and on said watercraft's peripheral gunwale areas include respectively stitched on and adhesively attached elongated strips of manually operable complemental, releasable, quick attach-detach hook and loop fastener means.

5. The canopy assembly of claim 4, wherein said respective two canopy pieces each have reenforced rearward edges and elongated free-end straps extending rearwardly beyond their respective peripheral side gunwale portions, said free-end straps also having complemental portions of said fastener means and adapted to facilitate the selective removal of said canopy members.

6. In combination with an inflated Navy assault craft having a generally U-shape inflated buoyancy tube and a rearward transom having an upper edge generally co-extensive with the craft's peripheral U-shape gunwale area, and having a plurality of circumferentially spaced D-ring securing means disposed interiorly along the inflated sides and at a rearward floor area, a generally low profile, non metallic, potentially expendable canopy system which can be readily assembled, erected and collapsed and jettisoned as circumstances dictate, said canopy system comprising (a) a normally straight but bowable, elongated, narrow band member of a length when disposed in a longitudinally bowed manner on the craft and when attached or anchored near its opposite ends to interior fore and aft portions of the craft, forms an arched canopy-supportable ridge member;

(b) a plurality of normally straight but bowable, elongated, narrow band members of a length shorter than said ridge-forming member, and adaptable to be resiliently arched into respective canopy-supporting bows, said bows adapted to be disposed transversely to said longitudinal bowed ridge member;

(c) said transversely disposable band members having opposite free ends adapted to resiliently engage with and be releasably retained collectively by said craft's interior side walls of said buoyancy tube and by said interiorly spaced D-ring securing means;

(d) means for at least temporarily interjoining said ridge member and said transversely disposed bow members to complete a canopy-supportable framework in conjunction with said watercraft;

(e) a generally rectangular shape, separable, two piece, longitudinally dividable, flexible canopy means having fastener means for releasably interjoining said two pieces along the longitudinal center area;

(f) said canopy means having fastening means along substantially all of an outermost periphery except for the rear transom area for releasably and selectively attaching it to complemental fastening means provided on the craft's peripheral gunwale area;

(g) whereby when installed on such a watercraft it will provide a readily detachable and selectively openable and closable canopy to protect the craft's occupants from adverse water spary and ambient atmospheric conditions.

7. The combination of claim 6, wherein said respective two canopy pieces each have reenforced rearward edges and elongated free-end straps extending rearwardly beyond their respective peripheral side gunwale portions, said free-end straps also having the complemental fastener means and adapted to facilitate the selective removal of said canopy members.

8. A method of providing a readily erectable and collapsible protective canopy system for watercraft which craft embodies a peripheral gunwale and rearward transom board, and a plurality of circumferentially spaced ring attachment means disposed along the inner periphery and at fore and aft longitudinal portions of said craft, said method comprising the steps of (a) selecting and using plurality of normally straight but bowable elongated narrow width members to form a canopy-supportable framework;

(b) using one of said bowable members as a bowed longitudinal center ridge member and securing it in bowed fashion to fore and aft portions of the watercraft;

(c) disposing a plurality of lesser lengths of the bowable members in a respectively bowed manner transversely to and at least in close proximity and preferably in physical contact by their medial portions with said ridge member, and inserting their opposite free ends through said respective ring attachment means along opposite sides of the inner periphery of said watercraft;

(d) removably attaching a longitudinally dividable two-part canopy along at least opposite lateral peripheral areas to the watercraft's gunwale areas by means of complemental quick-attach-detach fastener means such as the attached strips of mateable hook and loop fastener means; and (e) utilizing similar quick attach-detach complemental fastener means to selectively join and unjoin the two part canopy along the longitudinal center ridge member;

(f) whereby the canopy system may be readily erected, collapsed or jettisoned in whole or in part as circumstances may dictate.

9. The method of claim 8, further including during collapsing of the canopy portions, furling the respective two portions against the opposite gunwale areas of said craft and securing said portions in furled condition with the help of craft-attached safety lines pre-strung along said gunwale areas.

10. The method of claim 8, further including securing the transverse and center ridge bow members together by readily-removable fasteners.

11. The method of claim 8, further including providing on a foreward gunwale area one of two complemental parts of said quick attach-detach fastener means, and using the other of said complemental parts of said fastener means to attach thereto a foreward corresponding peripheral portion of the respective portions of said two part canopy.

* * * * *